United States Patent [19]

Mance et al.

[11] Patent Number: 5,034,246

[45] Date of Patent: Jul. 23, 1991

[54] METHOD FOR FORMING TUNGSTEN OXIDE FILMS

[75] Inventors: Andrew M. Mance, Royal Oak; Adolph L. Micheli, Mt. Clemens; Shyam P. Maheswari, Rochester Hills; Mohammad A. Habib, Troy, all of Mich.

[73] Assignee: General Motors Corporation, Detroit, Mich.

[21] Appl. No.: 568,293

[22] Filed: Aug. 15, 1990

[51] Int. Cl.[5] ..... B05D 5/12; B05D 3/02

[52] U.S. Cl. ..... 427/126.3; 427/106; 427/108; 427/126.1; 427/165; 427/226; 427/380

[58] Field of Search ..... 426/226, 380, 106, 108, 426/126.3, 126.1, 165

[56] References Cited

U.S. PATENT DOCUMENTS

| | | | |
|---|---|---|---|
| 3,617,341 | 11/1971 | Fetterman | 427/226 |
| 4,347,265 | 8/1982 | Washo | 427/126.3 |
| 4,960,618 | 10/1990 | Tanitso et al. | 427/126.3 |

OTHER PUBLICATIONS

Engelken et al, "Growth of Tungsten Selenide Films . . . ($(NH_4)_2$ $WSe_4$)", Mat. Res. Bull., vol. 20 (1985), pp. 1173–1179.

Yamanaka et al, "The Electrochromic Properties of . . . Organic Tungsten Compound", Jap J. Appl Phys, vol. 20 (4) (1981), pp. 307–308.

Unuma et al, "Preparation of Transparent Amorphous Tungsten Trioxide . . . Dip Coating Method", Jour. Mat. Sci. Letters 5 (1986), pp. 1248–1250.

Boyer et al, "New Preparation of . . . $W_6O_{19}$", C.R. Acad. Sci. Paris, 281 (Series C, 1975), pp. 59–62 (English Translation of the Original French version).

*Primary Examiner*—Janyce Bell

*Attorney, Agent, or Firm*—Douglas D. Fekete

[57] ABSTRACT

A method is disclosed for forming a tungsten oxide film on a substrate by applying an alkyl amine tungstate compound thereon and removing at least a portion of the alkyl amine tungstate compound to form a tungsten oxide film.

In a preferred embodiment, a solution of alkyl amine tungstate compound is formed in a solvent to uniformly apply the alkyl amine tungstate compound; the solvent is removed by evaporation thereby forming a deposit; the deposit is heated for a time and at a temperature sufficient to at least partially pyrolyze the alkyl amine tungstate compound.

The alkyl amine tungstate compound desirably may be selected from the group consisting of bis (di-n-octylammonium) tetratungstate, and di (n-octadecylammonium) tetratungstate. Preferably, bis (di-n-octylammonium) tetratungstate is used.

The invention also provides tungsten oxide films which include suboxides of tungsten oxides ($WO_3$); which have an average ratio of oxygen atoms to tungsten atoms equal to or less than 3:1; which are denser than films produced from currently known MOD precursor compounds; which have a color gradient, that is, regions of different color; and wherein the regions of color are electrochromic.

13 Claims, 1 Drawing Sheet

METHOD FOR FORMING TUNGSTEN OXIDE FILMS

BACKGROUND OF THE INVENTION

This invention relates to forming a tungsten oxide film on a substrate by applying an alkyl amine tungstate compound thereon and pyrolyzing at least a portion of the alkyl amine tungstate compound to form the tungsten oxide film. More particularly this invention relates to such method utilizing a solution containing the alkyl amine tungstate compound to uniformly apply the compound onto the substrate, drying the solution to form a deposit and heating the deposit for a time and at a temperature sufficient to achieve a desired composition of the tungsten oxide film.

In addition, the method includes forming a color gradient. That is, regions of the film having different colors are made by varying the time and temperature of heating for respective regions of the film. The regions are faint yellow to deep brown, and electrochromic. The method also results in the formation of suboxides of tungsten oxide ($WO_3$) at selected times and temperatures.

Tungsten is among the transition metals which form electrochromic metal oxide films. Electrochromic materials have variable light transmittance in response to an applied electrochemical potential. Such metal oxide films are used in electrochromic display devices wherein the film changes color when subjected to an electrical potential. A tungsten oxide film is typically preferred for this application due to its highly visible color change.

Tungsten oxide films are of interest for use as a coating for glass, to produce windows with controllable light transmission. For example, the automobile industry might use such coated windows to lower the amount of sunlight-generated heat in the passenger compartment of a car. The tungsten oxide, $WO_3$, film is normally a faint yellow, and when the film reacts with protons from an electrolyte it changes color. The corresponding electrochemical reaction is:

$$WO_3 + xM^+ + xe^- \rightleftharpoons M_xWO_3$$

where M =H, Li, K or Na (faint yellow to colorless) (blue, tungsten bronze).

This electrochromic reaction is sometimes characterized as a change from a bleached, white or colorless state to a colored state. The bleached state has relatively high transmittance and the colored state, relatively low transmittance.

Tungsten oxide, $WO_3$, has been reported to possess ferroelectric properties. Ferroelectric materials have potential for use in nonvolatile memory devices, that is, devices in which data is retained even when power is cut off. In addition, tungsten oxide may potentially be used for infrared temperature sensors.

Several methods are used to form tungsten oxide films. The methods include sputtering, chemical vapor deposition, and plasma enhanced chemical vapor deposition, in which sub-atmospheric pressure must be maintained. In these methods, large, complex and expensive equipment is needed, and the methods involve significant energy consumption and relatively high operating costs. The films produced by current methods are tungsten oxide films of $WO_3$, without suboxides, and which are colorless or faint yellow, single color films.

It has been suggested that tungsten containing films be formed by a metallo-organic deposition (MOD) method, wherein an organic metal compound is applied to a substrate which is heated to form the desired metal oxide film. Most MOD processes for deposition of transition metal oxides use carboxylate salts. However, tungsten carboxylates have not been easily synthesized.

It is an object of this invention to provide an MOD method for producing a tungsten oxide film by pyrolyzing at least a portion of an alkyl amine tungstate compound; in which the alkyl amine tungstate compound is a soluble alkyl ammonium salt of tungstic acid; in which time and temperature of heating are varied so as to provide a desired color gradient in the tungsten oxide film and suboxides of the tungsten oxide ($WO_3$); and which utilizes a precursor which produces a high tungsten oxide yield thereby forming a relatively dense tungsten oxide film.

It is a further object to provide tungsten oxide films which include suboxides of tungsten oxide ($WO_3$); which have an average ratio of oxygen atoms to tungsten atoms equal to or less than 3:1; which are denser than films produced from currently known MOD precursor compounds; which have a color gradient, that is, a single continuous film marked by regions of different colors; and wherein the regions of color are electrochromic.

In this method, tungsten oxide films are formed without vacuum equipment. Uniform faint yellow to white (colorless) films having essentially no organic matter or impurities are produced, or films having regions of color across the substrate are produced ranging from nearly colorless or faint yellow to deep brown, which offer the potential for inexpensively and controllably darkening windows.

SUMMARY OF THE INVENTION

In accordance with this invention, an MOD method forms a tungsten oxide film on a substrate by applying an alkyl amine tungstate compound thereon and removing at least a portion of the alkyl amine tungstate compound to form a tungsten oxide film.

In a preferred embodiment, a solution of alkyl amine tungstate compound is formed in a solvent to uniformly apply the alkyl amine tungstate compound; the solvent is removed by evaporation thereby forming a deposit; the deposit is heated for a time and at a temperature sufficient to at least partially pyrolyze the alkyl amine tungstate compound.

The alkyl amine tungstate compound desirably may be selected from the group consisting of bis (di-n-octylammonium) tetratungstate, and di (n-octadecylammonium) tetratungstate. Preferably, bis (di-n-octylammonium) tetratungstate is used. The bis (di-n-octylammonium) tetratungstate, $(n\text{-}C_8H_{17})_2NH_2)_2W_4O_{13}$, has a molecular weight of about 1424 and has four tungsten atoms. The corresponding weight per tungsten atom is 1424/4 or 356. A film formed from this precursor, which is a $WO_3$ film without suboxides, has a molecular weight of 229. Thus for each 229 grams of $WO_3$ to be formed, 356 grams of precursor are required, which is a yield of over 60 percent.

Preferably, the solvent is a vaporizable solvent. Solvents may be selected from the group of vaporizable organic solvents and preferably from the group of xylene, methanol and isopropyl alcohol. A polar component, such as an alcohol, must be present.

In one embodiment the solution containing the alkyl amine compound in the vaporizable solvent is applied onto a substrate having an electrically conductive layer and then the solution is dried to form a deposit. Then the deposit is heated for a time and a temperature sufficient to pyrolyze at least a portion of the alkyl amine tungstate compound to form a tungsten oxide film. In another embodiment, films may be formed, in a similar manner, but without the conductive layer. Therefore, the invention may be practiced using a desired substrate which may be electrically conductive or non-conductive. The selection of the substrate depends on the intended use of the film.

Preferably, the drying and heating steps are conveniently performed at the same time. That is, the vaporizable solvent may be vaporized during the heating step.

At a temperature of about 250° C. the pyrolysis begins. It has been found that the lowest temperature at which the organic material is completely pyrolyzed is at about 370° C. Lower temperatures require longer firing times. A heating time of at least about 5 minutes is required to form a brown film having electrochromic properties at temperatures in the range of 250° C. to 370° C. Vaporizing the solvent from the applied solution produces a substrate composed predominately of the alkyl amine tungstate compound.

Desirably, heating of the deposit occurs in the presence of an oxygen containing atmosphere for a time greater than about 5 minutes and at a temperature greater than about 450° C. to decompose the alkyl amine tungstate compound to produce a tungsten oxide film having electrochromic characteristics.

Heating for between about 5 and 10 minutes in the range of about 450° C. to 550° C. forms a film from partially pyrolyzed alkyl amine tungstate which is brown and which has a ratio of oxygen to tungsten atoms, O:W, which is less than 3:1 indicating the presence of suboxides. This film is a relatively tungsten rich film. The film also contains significant amounts of carbon. It is believed that such a film, having suboxides, has not been produced by current methods. Heating for between about 15 and 25 minutes at about 450° C. to 550° C. forms a faint yellow to colorless or white film.

It should be noted that the oven temperature will fluctuate. For example, if an average temperature of 500° C. is desired, the actual temperature may vary from 450° C. to 550° C.

Heating for about 5 minutes at between about 550° C. and 700° C. also forms a faint yellow to colorless or white film, depending on the film depth, which is characteristic of tungsten oxide films made by current methods such as reactive sputtering and chemical vapor deposition. The film has a O:W ratio of about 3:1, which is also characteristic of films produced by current methods. The film has essentially no measurable impurities. That is, the tungsten and oxygen content, by weight, is greater than 99 percent.

The ability to control the film color by changing the processing conditions can be used to produce some controllable and predictable color gradients. For example, yellow to brown color gradients or regions can be produced across a piece of glass by differences in either the time of heating or the temperature of heating.

A substrate may have a first region composed of a partially pyrolyzed alkyl amine tungstate compound which may be produced which exists alternatively in a reduced state characterized by a tungsten bronze color and in an oxidized state characterized by a distinct brown color. The substrate may also have a second region distinct from the first region which is composed of a fully pyrolyzed alkyl amine tungstate which exists alternatively in a reduced state characterized by a tungsten bronze color and In an oxidized state characterized by a distinct faint yellow color.

In a preferred embodiment, an ITO coated substrate was used and an alkyl amine tungstate compound in 50:50 2-propanol:xylene was deposited thereon and heated for about 20 to 25 minutes at about 450° C. to 510° C. in an oxygen containing atmosphere. This produced a film with transmittance between 800–1200 nm which is less than 25 percent in the color (reduced) state, and with a transmittance between 400 and 1200 nm which is greater than 80 percent in the bleached (oxidized) state. The bleached state is faint yellow to colorless or white, depending on the thickness of the film.

Each of the films produced are relatively dense as compared to films formed from known MOD methods. This results from the relatively high yield, over 60 percent, of the MOD process utilizing the alkyl amine tungsten compound precursor. Generally, increased density improves film quality and electrochromic characteristics.

Thus, the invention advantageously provides an MOD method for producing a tungsten oxide film by pyrolyzing at least a portion of an alkyl amine tungstate compound; in which the alkyl amine tungstate compound is a soluble alkyl ammonium salt of tungstic acid; in which time and/or temperature of heating are varied so as to provide a desired color gradient in the tungsten oxide film and suboxides of the tungsten oxide ($WO_3$); and which utilizes a precursor which produces a high tungsten oxide yield thereby forming a relatively dense tungsten oxide film.

The invention provides tungsten oxide films which include suboxides of tungsten oxide ($WO_3$); which have an average ratio of oxygen atoms to tungsten atoms equal to or less than 3:1; which are denser than films produced from currently known MOD precursor compounds; which have a color gradient, that is, regions of different color; and/or wherein the regions of color are electrochromic.

Thus, the method of the invention is relatively simple, energy efficient, and does not require complex equipment to produce sub-atmospheric pressure. Advantageously, the invention provides tungsten oxide films which have predictable, controllable, and desired properties, ranging from faint yellow/colorless films bearing no impurities, to deep brown films having suboxides, and a single, continuous film marked by regions of different color.

DETAILED DESCRIPTION OF THE PREFERRED EMBODIMENTS

Figure 1:
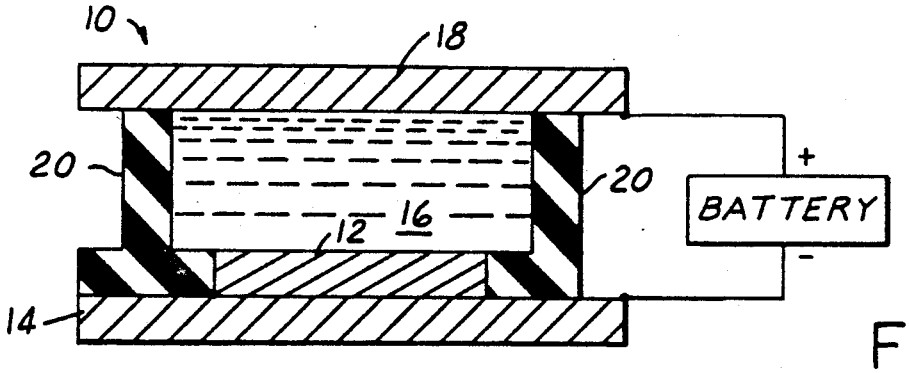
FIG. 1 is an electrochemical reaction cell.

Preferred embodiments of this invention which form tungsten oxide films of the invention comprise the steps of:

a) applying onto a substrate a solution containing an alkyl amine tungstate compound;
b) drying the solution to form a deposit; and
c) heating the deposit for a time and at a temperature sufficient to pyrolyze at least a portion of the alkyl amine tungstate compound to form a tungsten oxide film.

The alkyl amine tungstate compound desirably is selected from the group consisting of bis (di-n-octylammonium) tetratungstate, and di (n-octadecylammonium) tetratungstate, which are soluble in a solvent that is a suitable solvent for the alkyl amine tungstate compounds and that wets a desired substrate. A preferred solvent is a vaporizable organic solvent selected from the group of xylene, propanol and isopropyl alcohol, which have boiling points in the range of about 100° C. to 140° C. A polar component, such as alcohol, must be present.

EXAMPLE 1

In this preferred example, tungsten oxide films were formed from the precursor, bis (di-n-octylammonium) tetratungstate.

The bis (di-n-octylammonium) tetratungstate precursor was formed by adding a tungstic acid, preferably $H_2WO_4$, to di-n-octylamine, n-$C_8H_{17})_2NH$, in boiling water and boiling for one hour. The mixture must be stirred. The product was purified by washing in nearly boiling water. When the product resolidified, but before the amine solidified, the mixture was decanted. The product was then dissolved in the solvent (50:50 2-propanol xylene), filtered and heated to dryness. The product was than heated at about 120° C. for 2 hours and allowed to solidify, and remaining liquid was poured off. The purified and filtered remaining product was a glassy, yellow, transparent bis (di-n-octylammonium) tetratungstate product having the formula $(N\text{-}C_8H_{17})_2NH_2)_2W_4O_{13}$.

A 30 percent (by weight) solution of the bis (di-n-octylammonium) tetratungstate precursor was then prepared in 50:50 2-propanol:xylene solvent, and filtered through a 0.2 um pore size polypropylene membrane, to remove particles which may scratch the film surface.

The solution was applied onto glass substrates having a conductive layer of either indium tin oxide (ITO) or fluorine doped tin oxide (FTO). The solution was applied to each substrate by spin casting at 2000 rpm for 30 seconds.

The solution was heated in air, an oxygen containing atmosphere, in an oven for at least about 5 minutes at a temperature of at least about 250° C., and usually greater than 450° C., thereby forming tungsten oxide films.

It should be noted that the oven temperature in all the examples fluctuated. For example, if an average temperature of 500° C. was desired, the actual temperature may have varied from 450° C. to 550° C.

Vaporizing the solvent from the applied solution produces a substrate composed predominately of the alkyl amine tungstate compound.

EXAMPLE 2

In this example, the method of Example 1 was followed except that heating was done for about 5 minutes at an average temperature of about 500° C. thereby producing a tungsten oxide film which was a dark brown film.

EXAMPLE 3

In this example, the method of Example 2 was initially followed, that is, heating was initially done for about 5 minutes at about 500° C., producing a dark brown film, and then the firing was continued during which time the color faded, until after 20 minutes, the film was a faint yellow, to colorless or white.

Periodic observations during the 20 minute period were made and the oven temperature fluctuated from about 450° C. to 550° C. After about 5 minutes the film was a very dark brown; after about 10 minutes it was a light brown; after about 15 minutes the brown color was gone and a very faint yellow remained; after about 20 minutes the film was very faint yellow to white or colorless.

EXAMPLE 4

The method of Example 1 was followed except that heating was done for about 25 minutes at an average of about 500° C., (450° C. to 550° C.) producing a film which was a faint yellow to white. Both ITO and FTO substrates were used. In a preferred embodiment of this example, heating was done for about 20 to 25 minutes at about 450° C. to 510° C. and the ITO substrate was used.

EXAMPLE 5

The method of Example 1 was followed, except that heating was at an average of about 600° C. for about 5 minutes. A faint yellow to white film was formed.

EXAMPLE 6

The method of Example 1 was followed, except that heating was done for an average of about 5 minutes at an average of about 700° C. A faint yellow to white film was produced.

EXAMPLE 7

The method of Example 1 was followed except a 2"×2" glass substrate coated with a layer of indium tin oxide (ITO) was placed on a quartz holder so that one region of it, approximately a ¾" length, extended over the edge of the quartz holder. The quartz acted as a heat sink when the assembly was placed in an oven at an average of about 500° C. Because the oven was opened at 2 minute intervals, the oven temperature fluctuated between 450° C. and 550° C. The extended edge region of the continuous film heated faster and very probably got hotter than the balance of the specimen film. The extended edge region quickly darkened and eventually became a faint yellow. After 15 minutes the region of the continuous film overlying the quartz heat sink darkened. An inner extended edge region, adjacent an outer extended edge and adjacent the region overlying the quartz, was darker than the overlying region.

EXAMPLE 8

Tungsten oxide films were formed by the method of Example 1 except that other elements were incorporated into the film. The method included adding compounds having the desired element to the solution having the alkyl amine tungstate compound.

For instance, boron was added by first dissolving triethanolamineborate, $B(OCH_2CH_2)hd$ 3N in i-propyl alcohol then adding that solution to the solution having the alkyl amine tungstate compound. Silicon was added by direct addition of a liquid sold commercially by Petrarch as, that is, methylhydrocyclosiloxanes. Phosphorus was incorporated by adding tri-esters of phosphoric acid, that is, tris(2-ethyl-hexyl)phosphate, a liquid that was added directly to the solution having the alkyl amine tungstate compound. An ethanol solution of iron (III) acetylacetonate was added. A pyridine solution of Cu (II) acetylacetonate was also added. Tantalum (diethoxy) (tris(neo-decanoate)) dissolved in toluene provided incorporation of tantalum.

A methanol solution of lithium acetylacetonate provided incorporation of lithium in a $WO_3$ film, but solution resulting from the addition must be used soon after combination because a precipitate, probably $Li_2W_4O_{13}$, slowly formed. Palladium acetylacetonate was dissolved in a mixture of pyridine and i-propyl alcohol, then added to the solution to produce a film containing palladium. The tungsten and palladium containing solution is stable only for 1 to 2 hours before a precipitate forms.

Other compounds of these elements, and compounds of other elements could also be used in the solution provided they are compatible with the solvent and other components of the solution. More than one element could be added provided the same conditions are met for the mixture. The including of other elements may affect the time and temperature required to produce a desired color of film.

Tungsten oxide films formed by the methods of Examples 1 through 8 were formed on glass substrates having conductive layers of ITO or FTO. The composition of the layer was not found to significantly affect the time and temperature dependency. It should be noted that typical glass substrates may warp at temperatures in excess of 700° C. The films of the Examples 1–8 were all formed on such glass substrates, thereby limiting the temperature to 700° C. Other substrate layers include zinc oxide (ZnO), cadmium tin oxide ($CdSnO_4$) or other metal oxide compounds. The method may be practiced with other substrates, for example, high temperature glass, or other ceramic materials. Therefore, the invention may be practiced at temperatures in excess of 700° C., and may be useful for other $WO_3$ applications such as in forming ferroelectric memory elements.

Several layers of film may be applied to a substrate.

The results show that heating the deposit in the presence of an oxygen containing atmosphere for a time greater than 5 minutes and at a temperature greater than 450° C. decomposes the alkyl amine tungstate compound to produce a tungsten oxide film having electrochromic characteristics.

Referring to Table I, the results generally show that when fired in air for about 5 minutes at an average of about 500° C. (450° C. to 550° C.), the films were dark brown and the color became light brown after about 10 minutes (Examples 2 and 3). The color then gradually lightened until after about 20 minutes the films were a faint yellow to white (Example 3). Firing for an additional time up to about 25 minutes at an average of about 500° C. (450° C. to 550° C.) did not visibly change the film. Examples 3 and 4 are both faint yellow to white, no brown is present. When fired in air at an average of about 600° C. for about 5 minutes, the films are visually identical to the 20 minute, 500° C. firing (Examples 3 and 5). Specimens fired at an average of about 700° C. for about 5 minutes also produced faint yellow to white films (Example 6).

Table II contains the results obtained by using heat sinks to form regions of different color in accordance with Example 7. The film has three regions. Region A, overlying the quartz heat sink, was brown. Region B was formed at the outer extended edge of the substrate, and was faint yellow. Region C was between Regions A and B. Region C was a dark brown. It is thought that Region C cooled faster than Region A during the frequent inspection period when the oven was open. Cyclic voltammetry and UV-visible spectroscopy show that both the faint and dark zones are electrochromic. This was also visually observable to the human eye. Thus faint yellow to brown electrochromic color regions were produced across a continuous film on a substrate.

Thus, the invention produces films which have a first region composed of a partially pyrolyzed alkyl amine tungstate compound which exists alternatively in a reduced state characterized by a tungsten bronze color and in an oxidized state characterized by a distinct brown color. The substrate also has a second region distinct from the first region which is composed of a fully pyrolyzed alkyl amine tungstate which exists alternatively in a reduced state characterized by a tungsten bronze color and in an oxidized state characterized by a distinct faint yellow color.

Films having regions of different color may also be formed, by making use of temperature gradients that occur in ovens, such as cooler and warmer oven zones, and rotating the substrate. In addition, heat shields, such as screens, could be used.

TABLE I

| Example # | Average* Temperature °C. | Time Minutes | Color | Average O:W Ratio |
|---|---|---|---|---|
| 2, 3** | 500 | 5 | dark brown | less than 3:1 |
| 3 | 500 | 10 | light brown | — |
| 3 | 500 | 15 | yellow to faint yellow | — |
| 3 | 500 | 20 | faint yellow to white | 3:1 |
| 4 | 500 | 25 | faint yellow to white | 3:1 |
| 5 | 600 | 5 | faint yellow to white | 3:1 |
| 6 | 700 | 5 | faint yellow to white | 3:1 |

*Some fluctuation of oven temperature occurred. For example, an average temperature of 500° C. may correspond to a fluctuation between 450° C. and 550° C.
**Example 3 - Firing for up to 20 minutes with observations made at the times shown.

TABLE II

| Example # | Average* Temperature °C. | Time Min. | Specimen Configuration (Region) | Color |
|---|---|---|---|---|
| 7 | 500 | 15 | A | brown |
| 7 | 500 | 15 | B | faint yellow |
| 7 | 500 | 15 | C | dark brown |

NOTE:
A Region overlying quartz
B Outer extended edge region
C Inner extended edge region
*Some fluctuation of oven temperature occurred. For example, an average temperature of 500° C. may correspond to a fluctuation between 450° C. and 550° C.

The films of the invention are electrochromic and react with electrolyte protons in the presence of an applied electric field to change from a colored state to a bleached state. This reaction may be carried out in an electrochromic device 10 as in FIG. 1. The film 12 on a substrate 14 is contacted with an electrolyte 16 which is in turn contacted with a suitable counter electrode 18. An insulator 20 is disposed between the substrate electrode 14 an the counter electrode 18. When the substrate electrode 14 and the counter electrode 18 are connected through a battery, the film reacts with protons from the electrolyte 16. The electrochemical reaction of the films made of the invention thus corresponding to the following reaction:

$$WO_3 + xM^+ + xe^- \rightleftharpoons M_xWO_3$$

where M=H, Li, K or Na (brown or faint yellow to colorless) (blue, tungsten bronze).

The precursor and the resultant film products were analyzed to determine why the films were relatively dense and why film color is dependent on time and temperature. X-ray diffraction (XRD) and x-ray photoelectron spectroscopy (XPS) were used to examine films fired at different times and temperatures.

X-ray diffraction (XRD) was performed on a Diano XRD-8000 ($CuKa_1$radiation) scanned from 10 to 70 degrees at a rate of 5° $min^{-1}$. Diffraction patterns were obtained by preparing ITO glass with 5 layers of film produced in accordance with Example 2. In this case, each coat was spun onto the substrate followed by about a 5 min firing at an average of about 500° C. After the layers were applied, a diffraction pattern was obtained. Patterns were obtained for other specimens in a similar manner, for about 5 minutes at an average of about 600° C. and an average of about 700° C., respectively.

The XRD pattern of a specimen fired at an average of about 500° C. for about 5 minutes contained two broad peaks at 24.0 degrees and 29.8 degrees. Both of these peaks were sharper and more intense for the specimen fired for about 5 minutes at an average of about 600° C., and additional peaks appeared at 49.8 degrees, 61.4 degrees, and 55.3 degrees. All peaks were very sharp and intense after firing at an average of about 700° C. for about 5 minutes. These latter peaks correspond to the diffraction pattern of orthorhombic $WO_3$ and indicate that with longer firing or firing at higher temperatures, the film becomes more crystalline, and the initially formed (darker) films contain suboxides of $WO_3$.

X-ray photoelectron spectroscopy (XPS) depth profiling experiments were performed on a Surface Science Instruments SSX-101 instrument equipped with a differentially pumped Leybold-Heraeus ion source. Data was acquired using a monochromatic Alka x-ray source with a spot size of 300 μm. A hemispherical analyzer with a pass energy of 150 eV provided an energy resolution of 1.5 eV. Depth profiling was performed using a 4-KV $Ar^+$ion beam rastered over a 1-mm by 1-mm area. Elemental compositions were calculated by measuring the area under the photoelectron transition, and correcting this value using Scofield cross section and inelastic mean free path data.

The elemental compositions of films as a function of depth were determined by combining XPS with argon ion sputtering. A depth profile was obtained for a specimen fired at an average of about 700° C. for about 5 minutes producing a faint yellow to white film in accordance with Example 6. This film contained tungsten and oxygen. No impurities were found within the limits of detection, that is less than 1 percent impurities. The depth profile of this film was identical to one obtained from a $WO_3$ standard formed by the sputtering method, suggesting that the compositions of both films are similar.

A depth profile was obtained for a specimen fired at an average of about 500° C. for about 5 minutes, producing a dark brown film in accordance with Example 2. The oxygen-to-tungsten ratio for this specimen was less than 3:1. The ratio was probably as low as 1:1, however, the sputtering detection method is not able to provide highly accurate results at the low end of the O:W range. The results show that a tungsten rich film is formed at relatively low temperatures and/or relatively short times. The film includes suboxides of $WO_3$, formed due to incomplete reaction of the film. In addition, this dark film also contains significant amounts of carbon in addition to tungsten and oxygen. Since this specimen was fired at a lower temperature and for a shorter time, the carbon is probably present because of incomplete pyrolysis of the metallo-organic, alkyl amine tungstate compound.

The elemental analysis results show that the reaction product between the di-n-octylamine, $(n\text{-}C_8H_{17})_2NH$, and the tungstic acid, $H_2WO_4$, does not yield a precursor having a simple tungstate ($WO_4$), such as $((n\text{-}C_8H_{17})_2NH_2)_2(WO_4)$ Instead, the precursor had a tetratungstate ($W_4O_{13}$) group. The expected calculated yield of $WO_3$ for a simple tungstate precursor was about 30 percent. The invention produced a yield of over 60 percent.

Thermogravimetric analysis (TGA) results confirmed that the precursor had a tetratungstate $W_4O_{13}$-group and not a simple tungstate group. Therefore, elemental analysis and TGA results confirmed the precursor was an alkyl amine tetratungstate product of the formula $(n\text{-}C_8H_{17})_2\ NH_2)_2\ W_4O_{13}$.

The bis (di-n-octylammonium) tetratungstate compound $((N\text{-}C_8H_{17})_2NH_2)_2W_4O_3)$ precursor has a molecular weight of 1424 and has four tungsten atoms. The corresponding weight per tungsten atom is 1424/4 or 356. The tungsten oxide product has a molecular weight of 229 grams. Therefore, for each 356 grams of alkyl amine tetratungstate precursor, 229 grams of tungsten oxide film was produced. Thus the calculated yield was 229/356 which is about 64 percent. Thermogravimetric analysis (TGA) results confirmed that the precursor is a tetratungstate compound, with a yield of 61 percent.

The 61 percent $WO_3$ residue determined by TGA is reasonable considering that some W-containing material is likely to be carried off during volatilization of the tetratungstate. The formation of a tetratungstate is the result of condensation reactions and there may be higher polymetallates present since elemental analysis indicates that the product is rich in W.

Thus, the yield from the method of the invention is twice as great as the yield from a simple tungstate or a hexaphenoxide tungsten precursor. The film is therefore denser than that formed with the hexaphenoxide tungsten precursor. The film of the invention is equivalent in density to films formed by sputtering and chemical vapor deposition techniques.

A classical 3-electrode cell was used for the electrochemical measurements. A saturated calomel reference electrode (SCE) and a platinum spiral coil counter electrode were used. The electrochemical equipment included an EG&G PAR Potentiostate model 173, Universal Programmer model 175, and a Hewlett-Packard recorder.

For spectroelectrochemical measurements a 3-electrode cuvette cell with 1-cm path length was used. The electrolyte was 0.5 M $H_2SO_4$ in tri-distilled water. The cell was placed in the sample chamber of a Perkin-Elmer Lambda-9 spectrometer and in-situ transmittance spectra were recorded with the electrode polarized at each potential for 5 minutes.

Figure 2:
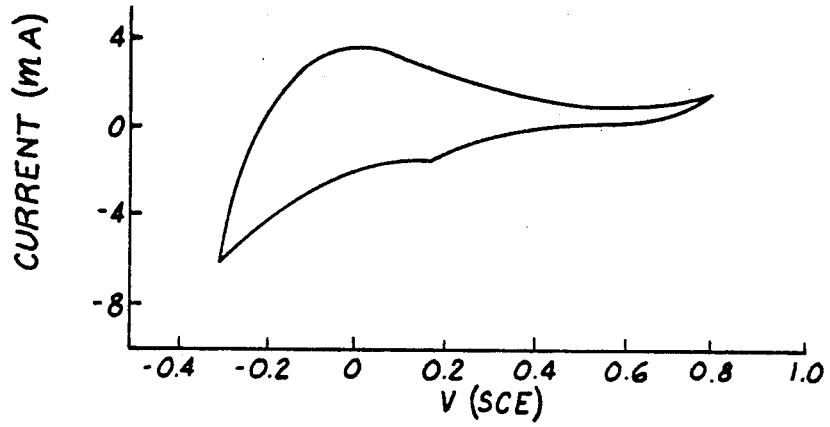
FIG. 2 is a cyclic voltammogram of an embodiment of the invention.

A cyclic voltammogram of the $WO_3$ film of Example 7 in 0.5 M $H_2SO_4$ (aq) is shown in FIG. 2. This film had faint and dark zones produced in accordance with the method of Example 7. The scan rate was 50 $mVs^{-1}$.

Figure 3:
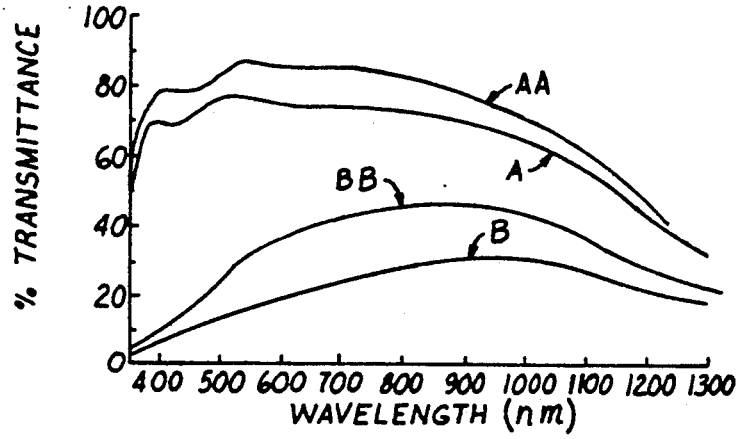
FIG. 3 is a transmittance spectra of the embodiment of FIG. 1.

UV-visible spectra of both the faint (A, AA) and dark (B, BB) regions of the film of Example 7 are shown in FIG. 3 with the electrode polarized at −0.7 V and at 0.7 V (SCE). The lines marked A and B are in-situ uv-vis-nir spectra of the light (A) and dark (B) region of the $WO_3$ film held at −0.7 V (SCE) in 0.5 M $H_2SO_4$ (aq). The lines marked AA and BB are in-situ uv-vis-nir spectra of the light (AA) and dark (BB) region of the $WO_3$ film held at +0.7 V (SCE) in 0.5 M $H_2SO_4$ (aq).

As shown in FIG. 3, the UV-visible spectra of the lighter region of the film (A, AA), produced by subjecting the film to higher temperatures during the film preparation, shows a maximum in transmittance around 500 nm. The darker region of the film (B, BB), however, shows a maximum around 1000 nm suggesting that the film still contains some unburned organic materials due to exposure of this region of the film to relatively milder pyrolysis conditions during film preparation. This is in agreement with the XPS results.

Both the darker and lighter portions of the film showed optical switching effects by switching the potential between the anodic and the cathodic limits (FIG. 3). Thus, by varying the temperature treatment at various portions of the film during preparation, one may obtain films with color gradients that exhibit electrochromic properties. The optical contrast between the reduced and the oxidized state (FIG. 2) is quite low compared to the contrast obtained with the sputtered film; however, by optimizing the preparation procedure, this contrast can be improved (FIG. 3).

Figure 4:
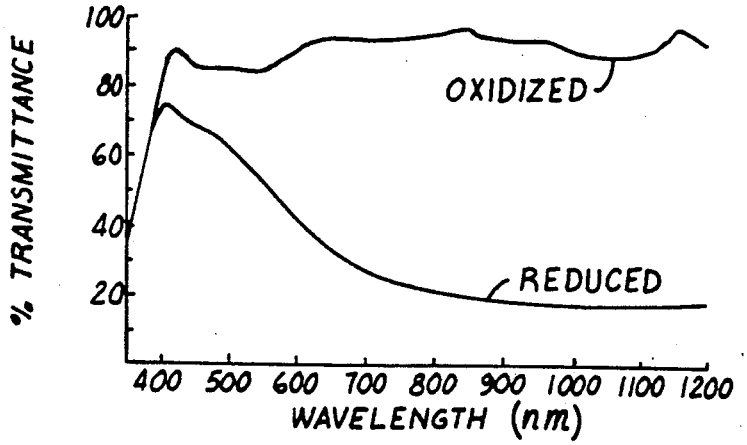
FIG. 4 is a transmittance spectra of another embodiment of the invention.

The cyclic voltammogram of the film of Example 4 in 0.5 M $H_2SO_4$ solution (aq) is very similar to that obtained with films made by reactive sputtering, chemical vapor deposition, or evaporation technique. In-situ transmittance spectra of the film of Example 4 was made in the oxidized state on ITO coated glass (+0.8 V (SCE)) and in the reduced state (colored) (−0.2 V (SCE)). The electrolyte was 0.5 M $H_2SO_4$ (aq). In FIG. 4, the spectra of the reduced and the oxidized film was made in accordance with Example 4 as shown. The transmittance of this film was found to vary from 15 percent in the colored state to 95 percent in the bleached state. This transmittance is similar to films made by other methods, such as sputtering. More specifically, the film of Example 4 had a transmittance between 800–1200 nm which is less than 25 percent in the reduced state and a transmittance between 400–1200 nm which is greater than 80 percent in the oxidized state.

When placed in a classical three-electrode electrochemical cell, the films of the invention can be doped with H+ which switches them to a uniform blue color. That is, a tungsten oxide film of a partially pyrolyzed alkyl amine tungsten compound exists alternatively in a reduced state characterized by a tungsten bronze color and in an oxidized state characterized by a distinct brown color. A tungsten oxide film of a fully pyrolyzed alkyl amine tungstate compound exists alternatively in a reduced state characterized by a tungsten bronze color and in an oxidized state characterized by a distinct faint yellow color.

The invention provides electrochromic tungsten oxide films having color gradients which may be used to controllably darken windows and mirrors. The invention provides processing conditions which can be controlled to alter the color of films, from brown to faint yellow and essentially colorless or white. Lower heating temperatures or shorter heating times produce a darker color, and, correspondingly, higher temperatures and longer heating times produce faint yellow or colorless film. A single, continuous film having regions of color or a color gradient is also produced.

The ability to control the film color by changing the processing conditions can be used to produce some interesting effects. It is possible that large glass parts could be given color gradients.

While the films of the invention may be used for electrochromic displays, window darkening and ferroelectric devices, the films may be used for other purposes.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for forming a tungsten oxide film comprising the steps of:

a) applying onto a substrate a solution containing an alkyl amine tungstate compound, b) drying said solution to form a deposit, and c) heating said deposit for a time and at a temperature sufficient to pyrolyze at least a portion of said alkyl amine tungstate compound to form a tungsten oxide film.

2. A method according to claim 1 wherein said alkyl amine tungstate compound comprises an alkyl amine tetratungstate compound.

3. A method according to claim 1 wherein said alkyl amine tungstate compound is selected from the group consisting of bis (di-n-octylammonium) tetratungstate, and di (n-octadecylammonium) tetratungstate.

4. A method according to claim 1 wherein said solution comprises a vaporizable organic solvent.

5. A method according to claim 4 wherein said solvent is a mixture of 2-propanol and xylene.

6. A method according to claim 1 wherein regions of said deposit are heated while varying said time for each respective one of said regions.

7. A method according to claim 1 wherein regions of said deposit are heated while varying said temperature for each respective one of said regions.

8. A method according to claim 1 wherein said solution consists of an organic compound which includes one of the group of boron, silicon, phosphorus, lithium, tantalum, and palladium.

9. A method for forming a tungsten oxide film comprising the steps of:

a) applying onto a substrate a solution containing an alkyl amine tungstate compound dissolved in a vaporizable organic solvent, b) vaporizing said solvent from the applied solution to produce a deposit on said substrate composed predominantly of said alkyl amine tungstate compound, and c) heating the deposit in the presence of an oxygen containing atmosphere for a time greater than 5 minutes and at a temperature greater than 450° C. to decompose said alkyl amine tungstate compound to produce a tungsten oxide film having electrochromic characteristics.

10. The method according to claim 9 wherein said temperature is between about 450° C. and 550° C. and said time is between about 5 and 10 minutes, thereby forming a brown tungsten oxide film.

11. The method according to claim 9 wherein said temperature is between about 550° C. and 700° C. and said time is about 5 minutes, thereby forming a faint yellow to white tungsten oxide film which has a percentage by weight of tungsten and oxygen greater than 99 percent.

12. The method according to claim 9 wherein said temperature is between about 450° C. and 550° C. and said time is between about 15 and 25 minutes, thereby forming a faint yellow to white tungsten oxide film which as a percentage by weight of tungsten and oxygen greater than 99 percent.

13. A method for forming a tungsten oxide film comprising the steps of:

a) applying onto an ITO coated substrate a solution containing an alkyl amine tungstate compound dissolved in 50:50 2-propanol:xylene solvent, b) vaporizing said 50:50 2-propanol:xylene solvent from the applied solution to produce a deposit on said ITO coated substrate composed predominately of said alkyl amine tungstate compound, and c) heating the deposit in the presence of an oxygen containing atmosphere for a time between about 20 and 25 minutes and at a temperature between about 450° C. and 510° C. to decompose said alkyl amine tungstate compound to produce a tungsten oxide film which in a reduced state has a transmittance between 800–1200 nm which is less than 25 percent and which in an oxidized state has a transmittance between 400–1200 nm which is greater than 80 percent.

* * * * *